United States Patent [19]

Waelti

[11] Patent Number: 4,841,682

[45] Date of Patent: Jun. 27, 1989

[54] PROCESS AND DEVICE FOR PRODUCING TURNED PARTS FROM RODS OR BARS

[75] Inventor: Werner Waelti, Selzach, Switzerland

[73] Assignee: Tschudin Werkzeugmaschinenfabrik, Grenchen, Switzerland

[21] Appl. No.: 180,110

[22] PCT Filed: Jul. 17, 1987

[86] PCT No.: PCT/CH87/00089

§ 371 Date: Mar. 17, 1988

§ 102(e) Date: Mar. 17, 1988

[87] PCT Pub. No.: WO88/00513

PCT Pub. Date: Jan. 28, 1988

[30] Foreign Application Priority Data

Jul. 21, 1986 [CH] Switzerland ..... 2913/86

[51] Int. Cl.[4] ..... B24B 5/04

[52] U.S. Cl. ..... 51/289 R; 51/103 TF; 51/105 SP

[58] Field of Search ..... 51/289 R, 103 TF, 103 R, 51/103 C, 105 R, 105 SP, 80 A, 81 R, 88, 89

[56] References Cited

U.S. PATENT DOCUMENTS 3,145,508 8/1964 Price ..... 51/105 R 3,881,887 5/1975 McMaster ..... 51/103 C

*Primary Examiner*—Frederick R. Schmidt

*Assistant Examiner*—Maurina Rachuba

*Attorney, Agent, or Firm*—Sherman and Shalloway

[57] ABSTRACT

In order to fabricate turned parts (18) out of a steel rod or bar (13) solely by grinding, the latter is chucked in oppositely disposed collets (14, 16) and is ground by two profiled grinding discs (20, 20') which act on it either sequentially or simultaneously. The two profiled grinding discs are advanced to (and plunged into) the rod or bar (13) (for plunge-cut grinding) at an acute angle of attitude thereto, and said discs rotate on respective axes (D, D') which are inclined with respect to the axis (B) passing through the collects. In this way, surfaces (1', 5, 6, 8, 10) which are perpendicular to the longitudinal axis (A) of the rod or bar and which may even face in opposite directions can be produced without having to rechuck the turned part (18). The usual types of profiled turned part segments (1, 2, 3, 4, 7, 9) may also be produced at the same time.

10 Claims, 3 Drawing Sheets

PROCESS AND DEVICE FOR PRODUCING TURNED PARTS FROM RODS OR BARS

The invention relates to a method of manufacturing profiled turned parts which are symmetric with respect to their longitudinal axis, whereby profiled turned parts which may include right- and left-facing normal faces can be produced from rods directly by grinding, without a necessity for a separate cutting-machining operation.

The invention also relates to a device for carrying out the above method of manufacturing profiled turned parts.

It is known to produce profiled turned parts which are axially symmetric with respect to their longitudinal axis by the method of machining rods (or bars) with a cutting tool. These rods are namely unhardened steel rods of round cross section. Turned parts produced in this manner, if they are to meet stringent requirements as to dimensional accuracy and axial symmetry, they must undergo hardening followed by grinding to dimensions.

This traditional technique, widely employed, e.g., in the clock industry and the fine machinery industry, has among its disadvantages the fact that relatively high rate of tool wear leads to a series of relatively large measurement deviations in the cut or lathed part, which deviations need to be corrected in the subsequent grinding operations. It has been sought to alleviate this known disadvantage by employing hard metal tools. However, there is another disadvantage which survives: In order to sharpen (regrind) the cutting tools, they must be removed from the cutting machine, remounted, and readjusted, which is time-consuming and adds to the cost of precision parts (which are already costly to manufacture). The dimensional differences in turned parts in a single production run may be so great that it will be difficult to grind the hardened or unhardened parts to proper dimensions, and the grinding wheel must be applied very slowly to the parts, particularly in the case of fine turned parts. This is because the rough dimensions differ so greatly from piece to piece. A consequence of this is that there may be substantial piece-to-piece differences in the time of the grinding operation (from beginning of grinding to sparking out, which latter is the point at which sparks cease); or there may be substantial differences in grinding depth from piece to piece, which can also be undesirable.

Accordingly, the underlying problem of the present invention is to devise a method and device which eliminate the disadvantages of the customary methods and devices for manufacturing turned parts, and produce economical, precision, axially symmetric profiled turned parts.

This problem is solved according to the invention by a method and by a device as set forth in the appended claims.

The invention enables high precision axially symmetric turned parts to be produced from rods or bars, solely by grinding. This has not been possible heretofore. Often, the invention will enable grinding to tolerance without any subsequent grinding step. Moreover, workpieces used may be of already hardened steel, thereby avoiding a subsequent hardening and regrinding to tolerance.

Additional advantages and details of the invention will be apparent from the following description and the associated drawings, in which the manufacture of a particularly difficult to produce precision part is described, which part has transverse shoulders, grooves, end faces, and the like.

Figure 3:
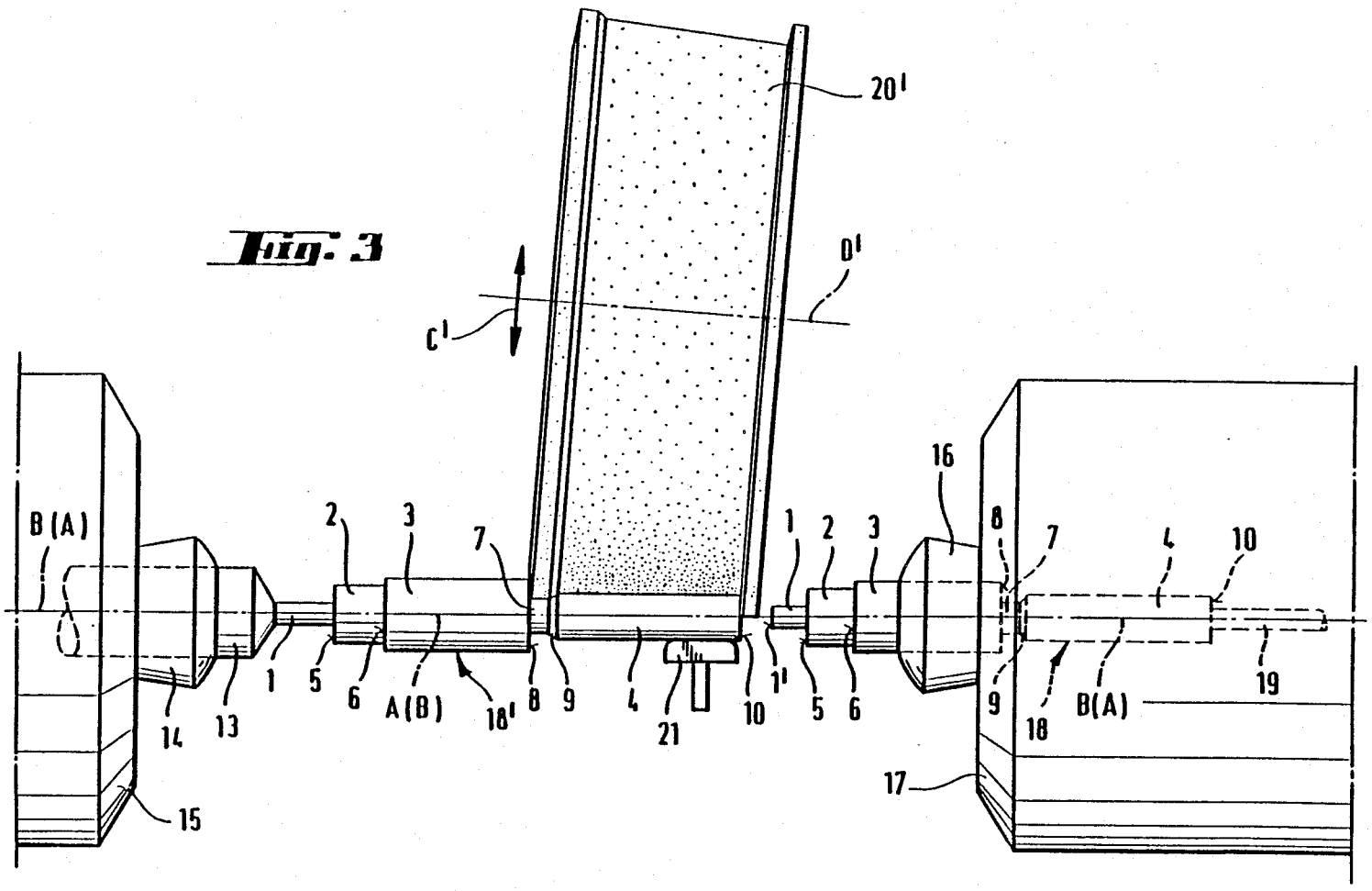
Figure 4:
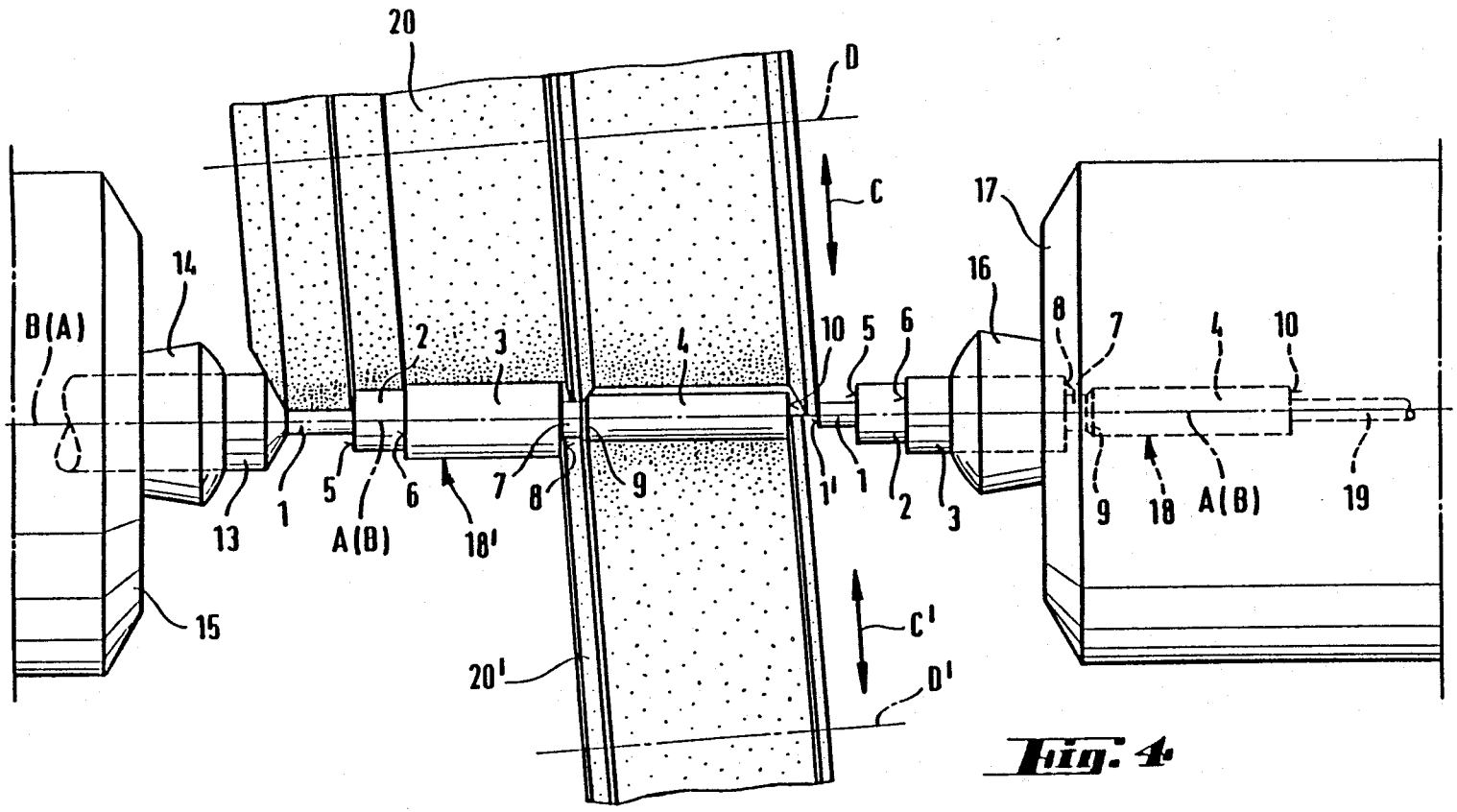

FIG. 3 is a schematic top view of the arrangement of a second part of the inventive device, wherewith a second operation in the inventive method of manufacturing the turned part is being carried out; and FIG. 4 is a schematic top view of an arrangement of the inventive device wherein the two parts of the device are combined, and the turned part is simultaneously ground by two profiled grinding discs.

Figure 1:
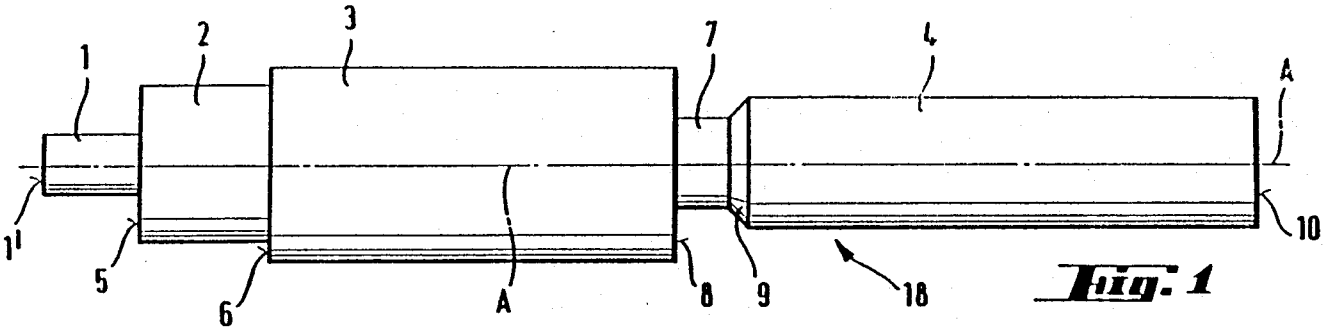
FIG. 1 is a side view of the turned part, enlarged.

FIG. 1 is an enlarged view of a turned part of a type which can be manufactured by the inventive method, using the inventive device, solely by grinding a round rod or bar of steel. The turned part is assumed to have a length of c. 50 mm and a mean diameter of c. 4.8 mm, which must be ground to a tolerance of 0.005 mm and the ends of which can have a maximum out-of-round of 0.001 mm. Further, the two ends 1' and 10, as well as the shoulder 5, the release transition 6, and the sides 8 of the groove 7, are to be absolutely perpendicular to the longitudinal axis A of the turned part.

It is not possible to manufacture such a turned part in a single operation by known techniques, particularly if the surfaces of the turned part must be finely ground. With the use of the invention, however, such a turned part can be manufactured from rod stock fully automatically. It is quite apparent what a substantial improvement the invention affords in serial production of difficult to produce high precision turned parts, in comparison to known manufacturing methods. The turned part illustrated has cylindrical regions, in particular an end pin 1, a release region 2, a large diameter region 3, and a smaller diameter region 4. The surfaces which are to be ground precisely perpendicular to the longitudinal axis A are an end 1', a shoulder 5, a release transition 6, a groove side 8, and a second end 10. A groove 7 separates the smaller diameter region 4 from the large diameter region 3. One of the sides of groove 7 is inclined (9), and the other is perpendicular (8).

One skilled in the art appreciates that the illustrated part chosen as a representative workpiece for illustrating the invention is a very difficult part to produce by ordinary methods and with ordinary devices; that it would be very costly to produce such turned parts in serial production by means of the customary method of cutting (lathing) and stepwise grinding of the various diameters, shoulders, ends, and angles; and that multiple chucking and handling of each turned part would be required. Accordingly, the turned part illustrated is well suited to demonstrating the advantages and potential of the present invention in comparison to the manufacturing means ordinarily employed for such turned parts.

In evaluating the advantages afforded by the invention over the state of the art, one must start with the fact that in any manufacturing method according to the state of the art a rough-cut workpiece will be first turned in a cutting (lathe) operation, from an unhardened steel rod or bar. The workpiece will then be hardened, and will be ground in a series of grinding operations. The first time the rough-cut workpiece is chucked the end pin 1, release region 2, large diameter region 3, end 1', shoulder 5, and release transition 6 are ground; then in a second chucking the small diameter region 4, groove side 8, and end 10 are ground. With this procedure it is nearly impossible to ensure the axial prallellness required, and to ensure that the tolerance specified for out-of-round will be met, because when the release region 2 and shoulder 3 are ground the workpiece is in a different chucking than when the small diameter region 4 is ground.

Figure 2:
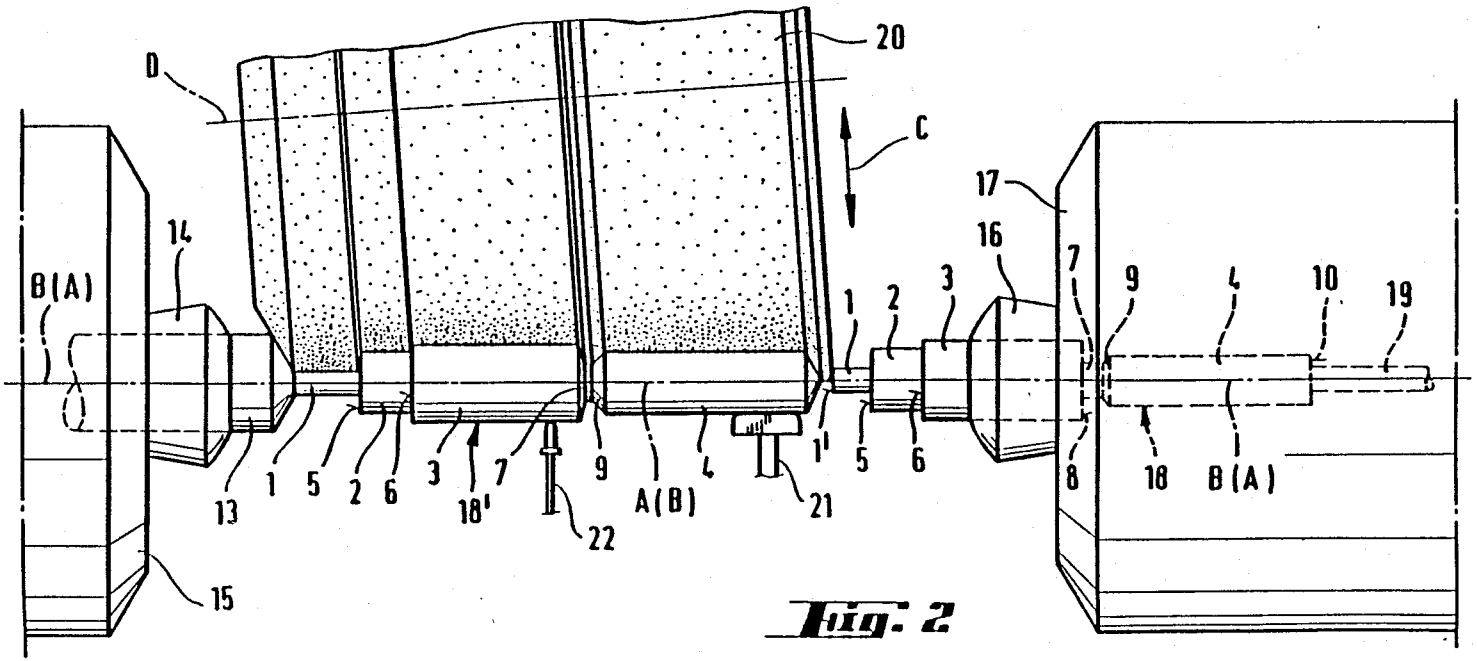
FIG. 2 is a schematic top view of the arrangement of a first part of the inventive device, wherewith a first operation in the inventive method of manufacture the turned part is being carried out.

FIG. 2 shows a round rod 13 which may be comprised of unhardened or hardened steel, which rod 13 is extended through a first collet 14 of the tool headstock 15. The turned parts are to be fabricated from this single rod, in sequence. A second collet 16 is disposed opposite collet 14 on the same axis B, in a synchronous tailstock 17. The rod 13 (or a turned part 18 still connected to the rod 13) is inserted in collet 16 up to a detent 19 which can be adjustably fixed in place. Advantageously, the headstock 15 and the synchronous tailstock 17 are components of a numerically controlled grinding machine, so that all operations and movements can be controlled automatically.

Also shown in FIG. 2 is a profiled grinding disc 20 and a steadying piece 21. The axis B between the collets, which axis coincides with the longitudinal axis A of the turned part into which the rod 13 is being ground, is not perpendicular to the direction of advance (double arrow C) of the profiled grinding disc 20 but is at an oblique angle thereto. The rotational axis D of the disc 20 is correspondingly inclined with respect to the longitudinal axis A of the turned part 18, i.e., 18', and the axis B. An inclination of c. 10° has proven advantageous. This enables correspondingly inclined portions of the profiled grinding disc 20 to be used to correctly grind surfaces on the turned part which surfaces are to be perpendicular to the longitudinal axis A, e.g. the end surface 1', the shoulder surface 5, and the release transition surface 6, whereby the ground surfaces are truly perpendicular to axis A of the turned part.

Advantageously, the grinding disc 20 is configured such that it can grind the following surfaces in a single working step (although possibly with a plurality of passes): the end pin 1, the release region 2, the large diameter region 3, the normal surfaces to region 3 (here the shoulder 5 and the release transition 6)—of a first turned part 18'; and the end face 1' of the turned part 18 which has been completed except for the end face 1' and has been advanced into the second collet 16. The small diameter region 4 can also be pre-ground in this step. Additionally, the small diameter region 4 of a third turned part, namely of a turned part still essentially disposed in the first collet 14, may be pre-ground in this step. In order to prevent deflection of the currently being ground turned part 18 away from the axis B, which would lead to dimensional errors, the steadying piece 21 is suitably disposed.

A second working step can be carried out with the rod 13 still chucked as before in collet 14 (and where again a plurality of passes may possibly be employed). In this step (FIG. 3), the side 8 of the groove and the end face 10 are ground by a second profiled grinding disc 20'. Final grinding of the small diameter region 4 may also be performed in this step. The grinding disc 20' is inclined with respect to the longitudinal axis A of the turned part 18, as was disc 20, however in this instance the inclination of the rotational axis D' of disc 20' is the mirror image of the axis D of disc 20, with respect to the normal plane to the axis B connecting the collets.

As soon as the workpiece 18' has been fully pre-ground and the end face 1' of turned part 18 has been completely ground, advantageously the second collet 16, in the synchronous tailstock 17, is opened and is retracted such that turned part 18, which has been partially inserted in collet 16 and has now been separated from rod 13, can be ejected from collet 16 by the detent 19, after which the rod 13 is advanced until the turned part 18' (still connected to rod 13) has been moved into the former position of turned part 18 in the second collet 16. Then the above-described two-step grinding operation is carried out again, possibly after a preliminary retraction of the grinding discs 20 and 20'. Thereby a third turned part is pre-ground and turned part 18' is final-ground.

It may be advisable to check a critical diameter of the turned part during the grinding process, by means of a diameter-measuring head 22, with the measurement then being used to control the advance of the profiled grinding disc.

The turned parts fabricated according to the described grinding operation, if ground from hardened rods 13, are now finished products, and need no further treatment. Even if the turned parts 18 are ground from unhardened rods 13, their dimensions are more accurate and the surfaces are finer than if they had been fabricated by a cutting (lathe) operation. Nonetheless, it may be necessary to further machine them after hardening, in order to ensure the required precision. In such a case the turned parts 18 will be provided with slightly oversized dimensions, and will be ground to size only in the final grinding.

It may be advantageous to combine the two working steps (which were described in connection with FIGS. 2 and 3) into a single working step, such that the profiled grinding discs 20 and 20' are applied to the rod 13 (or the turned parts 18' and 18) from mutually opposed positions. This variant of the invention is illustrated in FIG. 4.

One skilled in the art will appreciate that the inventive method and device enable a turned part to be produced with a single chucking (and two working steps) which would require two chuckings to produce according to customary methods. It is obvious that the inventive method and device enable manufacture of other turned parts than the part described here which is manufactured economically and with a single chucking. To do so it is sufficient to adjust the profiled grinding discs 20 and 20', and if necessary the steadying piece 21, to the given conditions. There is nothing novel or nonobvious in making such adjustments.

If an automatic device for the feeding of rods in succession is used, the manufacture of turned parts according to the invention can be fully automated, without need for manual adjustments of the grinding tools, because the profiled grinding discs can be honed directly while on the numerically controlled grinding machines, by means of diamond rollers, and can be automatically realigned, as is known in the art.

If coiled material is used instead of straight rod or bar as the starting stock for the manufacture of turned parts, which is a possibility due to the much lower rpm which is required for a ground piece in comparison to a cutting-machined piece, fully automatic manufacturing of parts can be set up to continue autonomously for days, without human intervention. This is not an achievable option with cutting machine (lathe) operations, because such operations invariably require a subsequent grinding stage to sharpen the cutting tool, which grinding is carried out outside the machine, followed by hand readjustment.

Individual steps of the inventive method, and components of the inventive device, may be modified as required by the characteristics of the parts being fabricated.

I claim:

1. A method of manufacturing profiled turned parts which are symmetric with respect to their longitudinal axis (A), with the starting stock being rods or bars, whereby a rod or bar (13) from which the turned parts (18) are to be fabricated is advanced on a collet axis (B) joining first and second collets, said advancing proceeds through said first collet (14) in a headstock (15) of a grinding machine comprised of at least the said headstock (15) and a synchronous tailstock (17), with said advancing continuing into said second collet (16) disposed in the synchronous tailstock (17), and said rod or bar is then ground by a profiled grinding disc (20) which can be advanced transversely with respect to said rod or bar; characterized in that the profiled grinding disc (20) is rotated around an axis (D) which is inclined with respect to the collet axis (B), and is advanced against the rod or bar (13) at an acute angle, such that faces (1', 5, 6) which are perpendicular to the longitudinal axis (A) of the rod or bar can be produced by plunging the said disc into the rod or bar (13) in a plunge-cut grinding operation; and in that a second profiled grinding disc (20'), also having a rotational axis (D') which is inclined with respect to the collet axis (B), is advanced against the rod or bar at an acute angle whereby it is possible to produce opposite transverse faces (8, 10) on the rod or bar (13) which faces are perpendicular to the axis (A) of the rod or bar.

2. A method according to claim 1; characterized in that profiled grinding discs (20, 20') are used which can grind other profile regions into the rod or bar (13) in addition to the transverse faces (1', 5, 6, 8, 10).

3. A method according to claim 1; characterized in that the two profiled grinding discs (20, 20') grind the rod or bar (13) in respective successive working steps.

4. A method according to claim 1; characterized in that the two profiled grinding discs (20, 20') grind the rod or bar (13) simultaneously, acting from opposite sides thereof.

5. A method according to claim 1; characterized in that one or both of the profiled grinding discs (20, 20') simultaneously grind(s) two turned parts (18, 18') which can be fabricated from the rod or bar (13).

6. A method according to claim 3; characterized in that at least one part of the rod or bar (13) is supported by a steadying piece (21).

7. A method according to claim 1; characterized in that the part (18') of the rod or bar (13) which part is disposed in the second collet (16) is severed from the rod or bar by a profiled grinding disc (20).

8. A device for carrying out the method of claim 1 on a grinding machine, comprised of at least one headstock (15) with a first collet (14), further comprised of a synchronous tailstock (17) disposed opposite the headstock (15) on an axis (B), and a second collet (16); characterized in that the subject device is further comprised of at least two profiled grinding discs (20, 20') which are individually or jointly controllable and fixable, wherewith said discs are disposed such that their rotational axes (D, D') are inclined with respect to the longitudinal axis (A) of the turned parts (18) which are being fabricated out of the rod or bar (13), and said discs can be advanced to and plunged into the rod or bar (13) for plunge-cut grinding while said discs are at an acute angle of attitude.

9. A device according to claim 8; characterized in that a translatable detent (19) for the rod or bar (13) is disposed in the synchronous tailstock (17).

10. A device according to claim 8; characterized in that the two profiled grinding discs (20, 20') are oppositely disposed with respect to the longitudinal axis (B) passing through the collets.

* * * * *